US007322878B2

(12) United States Patent
Toft

(10) Patent No.: US 7,322,878 B2
(45) Date of Patent: Jan. 29, 2008

(54) BELT GRINDER AND ATTACHMENT FOR GRINDING PIPE ENDS

(75) Inventor: Jorn Toft, Harrislee (DE)

(73) Assignee: Multi-Tool A/S, Jelling (DK)

( * ) Notice: Subject to any disclaimer, the term of this patent is extended or adjusted under 35 U.S.C. 154(b) by 301 days.

(21) Appl. No.: 11/087,769

(22) Filed: Mar. 24, 2005

(65) Prior Publication Data

US 2006/0148388 A1 Jul. 6, 2006

Related U.S. Application Data

(63) Continuation-in-part of application No. 11/029,398, filed on Jan. 6, 2005, now abandoned.

(51) Int. Cl.
*B24B 21/00* (2006.01)

(52) U.S. Cl. ..... 451/309; 451/311

(58) Field of Classification Search ..... 451/296, 451/297, 302, 305, 309, 311
See application file for complete search history.

(56) References Cited

U.S. PATENT DOCUMENTS 5,437,570 A * 8/1995 Landhuis ..... 451/296
6,544,112 B1 * 4/2003 Fuchs ..... 451/297
6,648,737 B2 * 11/2003 Deware et al. ..... 451/59
2002/0151261 A1 * 10/2002 Liou ..... 451/311

FOREIGN PATENT DOCUMENTS

| | | |
|---|---|---|
| DE | 42 26 708 A1 | 8/1993 |
| DE | 93 20 750 U1 | 1/1995 |
| DE | 295 04 077 U1 | 4/1995 |
| DE | 299 04 027 U1 | 5/1999 |
| DE | 102 53 364 A1 | 6/2003 |

OTHER PUBLICATIONS

European Search Report Dated Apr. 12, 2005.

* cited by examiner

*Primary Examiner*—Jacob K. Ackun, Jr.
(74) *Attorney, Agent, or Firm*—Aslan Baghdadi; Paul, Hastings, Janofsky & Walker LLP

(57) ABSTRACT

A belt grinder includes a motor, a driving disc, a contact disc, a grinding belt, and a housing, where the motor and the driving disc are moveable with respect to the contact disc in order to vary the distance between the axis of the contact disc and the axis of the driving disc. An attachment is secured to the belt grinder that includes a contact roll around which the grinding belt is fitted. The center to center distance between the contact roll of the attachment and the contact disc of the belt grinder is maintained as contact rolls of different diameter are used. The motor and driving disc are moveable with respect to the contact disc to vary an angle between the axis of the contact disc and an axis of the driving disc.

6 Claims, 13 Drawing Sheets

BELT GRINDER AND ATTACHMENT FOR GRINDING PIPE ENDS

CROSS-REFERENCE TO RELATED APPLICATION

This application is a continuation-in-part of U.S. patent application Ser. No. 11/029,398, filed Jan. 6, 2005, now abandoned which is herein incorporated by reference in its entirety.

BACKGROUND OF THE INVENTION

1. Field of the Invention

Embodiments of the present invention relate to a belt grinder. More particularly, embodiments of the present invention relate to a multi-functional belt grinder, preferably used in combination with an attachment, suitable for grinding several different diameters at varying angles.

2. Background Information

Belt grinders are well known to have integrated motors, switches, and other expensive components. Belt grinders are used in the manufacturing of, for example, railings, frame structures, pipe ends, and other pipe structures, as well as shop fittings. The manufacture of these structures requires belt grinders capable of grinding several different diameters at varying angles.

BRIEF SUMMARY OF THE INVENTION

One embodiment of the present invention is a belt grinder including a motor, a driving disc, a contact disc, a grinding belt, and a housing, where the motor and the driving disc are moveable with respect to the contact disc in order to vary the distance between the axis of the contact disc and the axis of the driving disc. The driving disc is coupled to the motor. The grinding belt is routed over the driving disc and the contact disc. The housing encloses the driving disc, the contact disc, and the driving belt. The motor and the contact disc are moveably mounted to the housing.

In another embodiment, a cover plate, a pneumatic spring, and a lever are used to vary the distance between the axis of the contact disc and the axis of the driving disc. The a cover plate is slideably mounted to the housing. The motor is connected to the cover plate. The pneumatic spring is connected at one end to a lever and at the opposite end to the cover plate. The lever is connected to the housing and moves the pneumatic spring and the cover plate to vary the distance between the axis of the contact disc and the axis of the driving disc.

In another embodiment, a cover plate, a mechanical spring, and a lever are used to vary the distance between the axis of the contact disc and the axis of the driving disc. The a cover plate is slideably mounted to the housing. The motor is connected to the cover plate. The mechanical spring is connected at one end to a lever and at the opposite end to the cover plate. The lever is connected to the housing and moves the mechanical spring and the cover plate to vary the distance between the axis of the contact disc and the axis of the driving disc.

In another embodiment, a cover plate and a threaded spindle are used to vary the distance between the axis of the contact disc and the axis of the driving disc. The a cover plate is slideably mounted to the housing. The motor is connected to the cover plate. The threaded spindle is connected at one end to the housing of the belt grinder and at the opposite end to the cover plate. The threaded spindle moves the cover plate to vary the distance between the axis of the contact disc and the axis of the driving disc.

In another embodiment of the present invention, an attachment secured is to the belt grinder that includes at least one contact roll around which the grinding belt is fitted. The attachment includes a collecting tank for shavings. The collecting tank is filled with a cooling medium. The attachment includes a mechanical locking device to secure the attachment to the belt grinder. The center to center distance between the contact roll of the attachment and the contact disc of the belt grinder is maintained as contact rolls of different diameter are used. The distance between the axis of the contact disc and the axis of the driving disc is varied to maintain the center to center distance between the contact roll of the attachment and the contact disc of the belt grinder.

In another embodiment of the present invention, a cover plate is mounted to the housing of the belt grinder. A motor flange is fixed to the cover plate at one end and is allowed to move at the opposite end. The motor is connected to the motor flange. A threaded spindle is connected to the cover plate and the moveable end of the motor flange. The threaded spindle moves the moveable end of the motor flange away from the cover plate to vary the angle between the axis of the contact disc and the axis of the driving disc.

Figure 1:
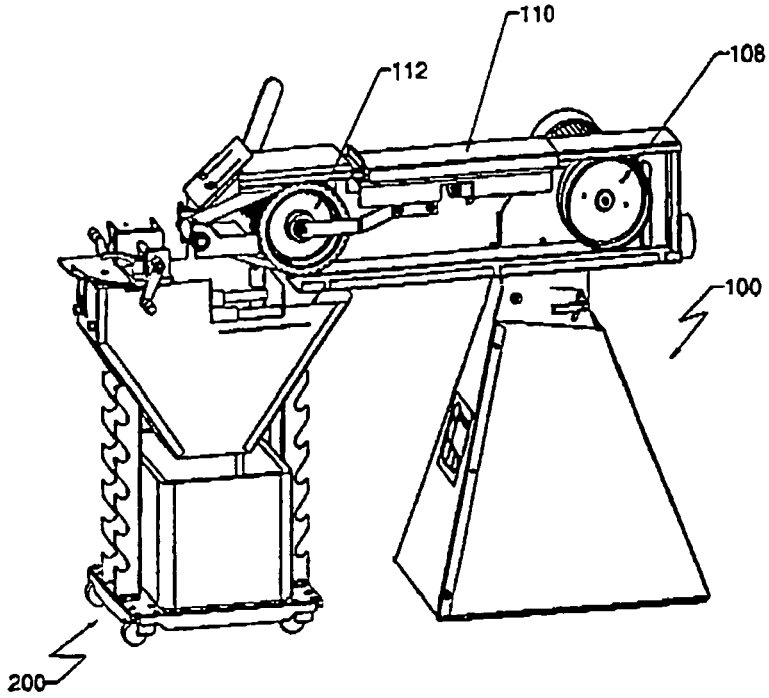
FIG. 1 is a schematic diagram of a belt grinder, partially open, fitted with an attachment, in accordance with an embodiment of the present invention.

Before one or more embodiments of the invention are described in detail, one skilled in the art will appreciate that the invention is not limited in its application to the details of construction, the arrangements of components, and the arrangement of steps set forth in the following detailed description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

FIG. 1 is a schematic diagram of a belt grinder 100, partially open, fitted with an attachment 200, in accordance with an embodiment of the present invention. Belt grinder 100 is suitable for indoor industrial use under non-humid conditions for grinding, for example, steel, stainless steel, and metals.

Figure 2:
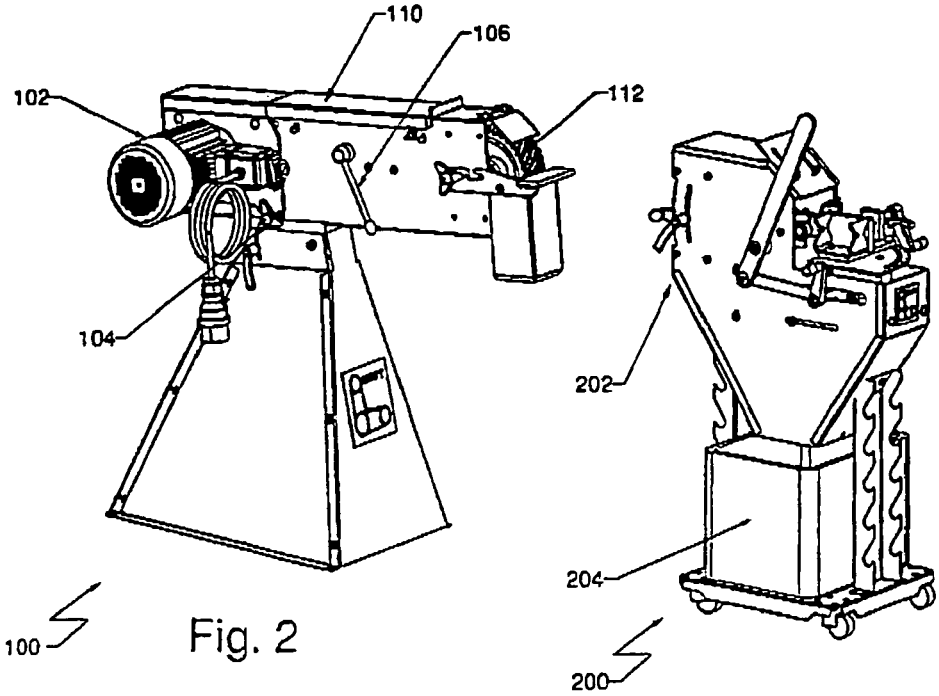
FIG. 2 is a schematic diagram of a belt grinder and a belt grinder attachment in a separated state, in accordance with an embodiment of the present invention.

FIG. 2 is a schematic diagram of a belt grinder 100 and a belt grinder attachment 200 in a separated state, in accordance with an embodiment of the present invention. A grinding belt is actuated by motor 102. Adjusting mechanism 104 can move the grinding belt laterally. Lever mechanism 106 tightens and loosens the grinding belt. Motor 102 drives driving disc 108 (shown in FIG. 1), which moves a grinding belt along horizontal grinding table 110 (shown in FIG. 1), which may be either raised or lowered, and around contact disc 112 (shown in FIG. 1) back to driving disc 108.

In another embodiment of the present invention, belt grinder 100 is operated with attachment 200 that is fixed to belt grinder 100 using a mechanical fixing mechanism 224 (shown in FIG. 4), which is, for example, a simple screw connection. A longer grinding belt is correspondingly led up to attachment 200, adjusted, and fixed to attachment 200. Contact role 206 (shown in FIG. 3) can be moved using height adjustment 202. Integrated collecting tank 204 that is filled with a cooling medium, such as water, collects the abrasive dust that results from grinding.

Figure 3:
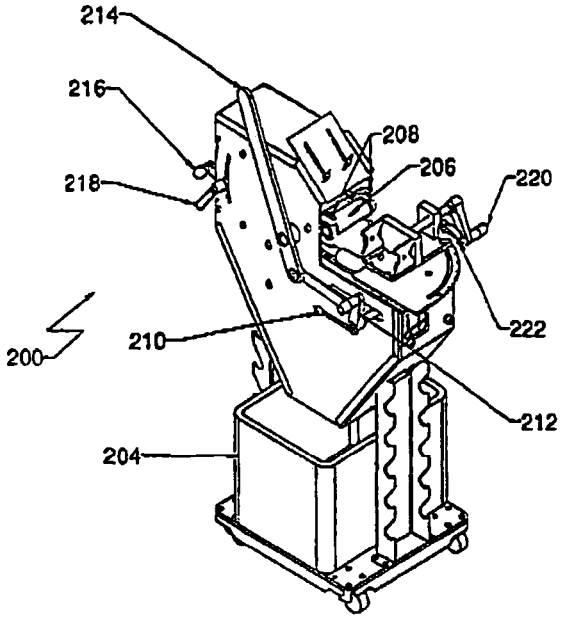
FIG. 3 is a schematic diagram of a detailed view of a belt grinder attachment, in accordance with an embodiment of the present invention.

FIG. 3 is a schematic diagram of a detailed view of a belt grinder attachment 200, in accordance with an embodiment of the present invention. Contact role 206 can be released and replaced by opening a mechanical locking device 208. A corresponding fixation ensures a secure fit. Lock screw 210 permits the setting of the structure or workpiece depth position stop, and rotational lever 212 controls sideward movement by way of a cross slide. Feeding is controlled by adjusting lever 214. Lever 216 and lever 218 allow for the adjustment of the center height of contact roll 206. Finally, screw vice 220 holds the workpiece in place. Mechanism 222 adjusts the angle with a large ten degree nick and a small five degree nick. Basically, nicks of any size between thirty degrees and ninety degrees can be set following the above steps or adjusted to any desirable setting.

To connect belt grinder 100 and attachment 200, the electrical voltage is first turned off at the main switch and all eye protection and knurled screws are dismantled if they are interfering. The grinding mat and abrasive dust collecting tank must also be removed.

Figure 4:
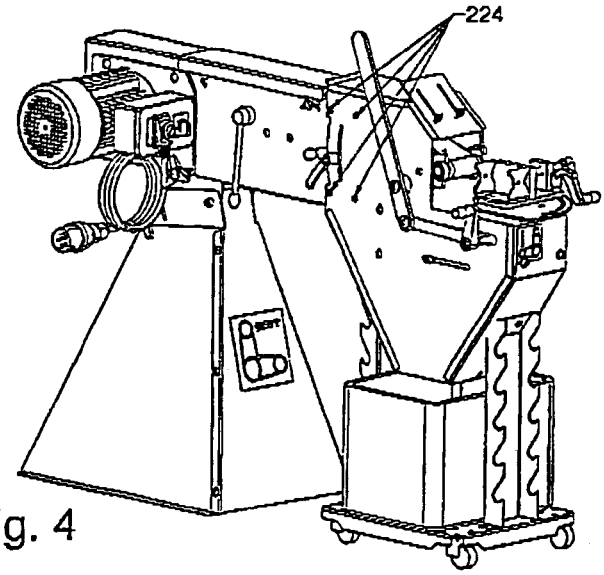
FIG. 4 is a schematic diagram showing further structural details between a coupling mechanism of a belt grinder and a belt grinder attachment, in accordance with an embodiment of the present invention.

FIG. 4 is a schematic diagram showing further structural details between a coupling mechanism of a belt grinder 100 and a belt grinder attachment 200, in accordance with an embodiment of the present invention. Belt grinder 100 and attachment 200 are held together by fixing mechanism 224, which includes four bolts. The grinding belt may be removed and a desired contact role is inserted into a clamp. Then the new grinding belt is inserted and tightened.

Figure 5:
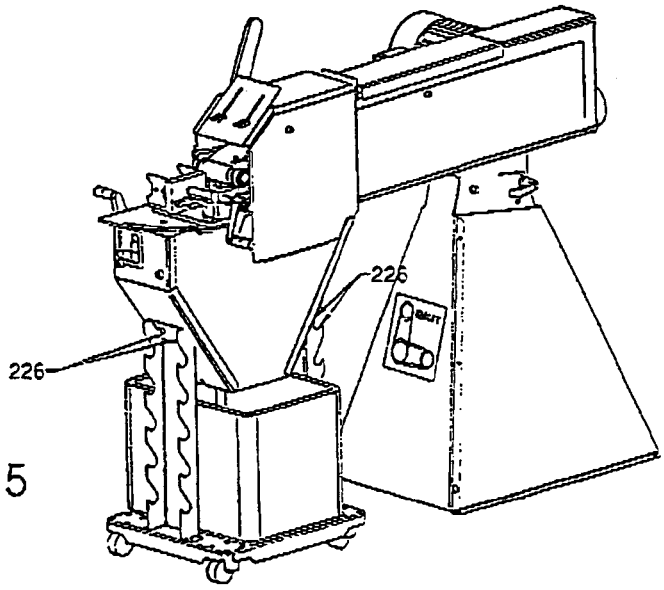
FIG. 5 is a schematic diagram of a perspective view of a belt grinder attachment fitted to a belt grinder, in accordance with an embodiment of the present invention.

FIG. 5 is a schematic diagram of a perspective view of a belt grinder attachment 200 fitted to a belt grinder 100, in accordance with an embodiment of the present invention. Tipping settings 226 must be adjusted before initial installation.

Figure 6:
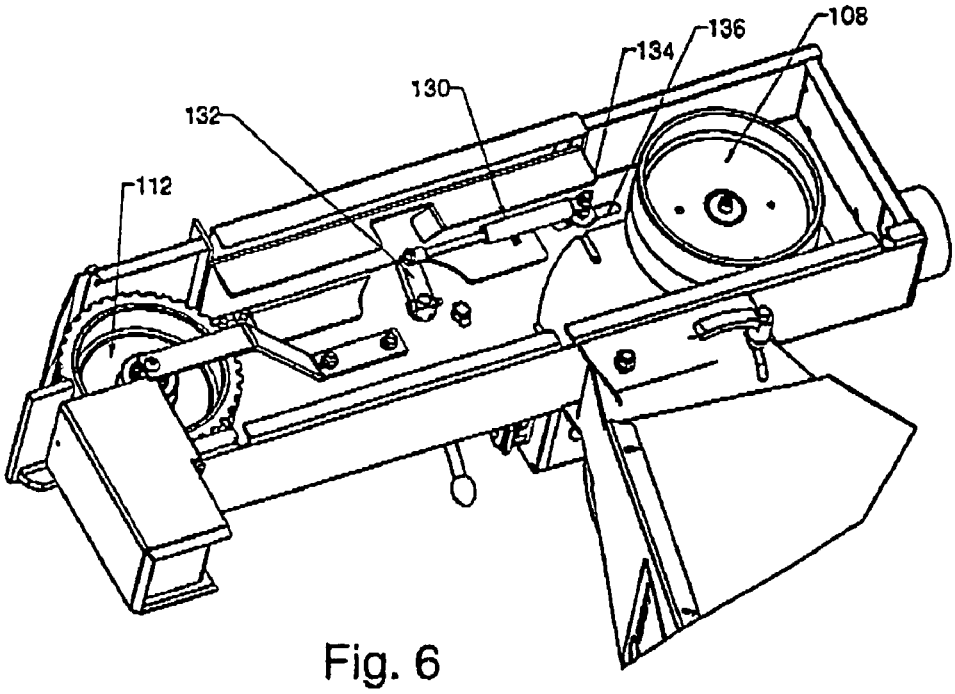
FIG. 6 is a schematic diagram of a view of a belt tension mechanism in a belt grinder including a contact disc and driving disc, in accordance with an embodiment of the present invention.

FIG. 6 is a schematic diagram of a view of a belt tension mechanism in a belt grinder 100 including a contact disc 112 and driving disc 108, in accordance with an embodiment of the present invention. End 132 of pneumatic spring 130 is secured to lever 106 while end 134 is movable in elongated hole 136 in belt grinder 100, but can still be secured in place as shown. Contact disc 112 and end 132 are connected to belt grinder 100 housing. Alternative belt tensioning mechanisms are possible, for example, using a mechanical coil spring, an eccentric part, or a threaded spindle.

Figure 7:
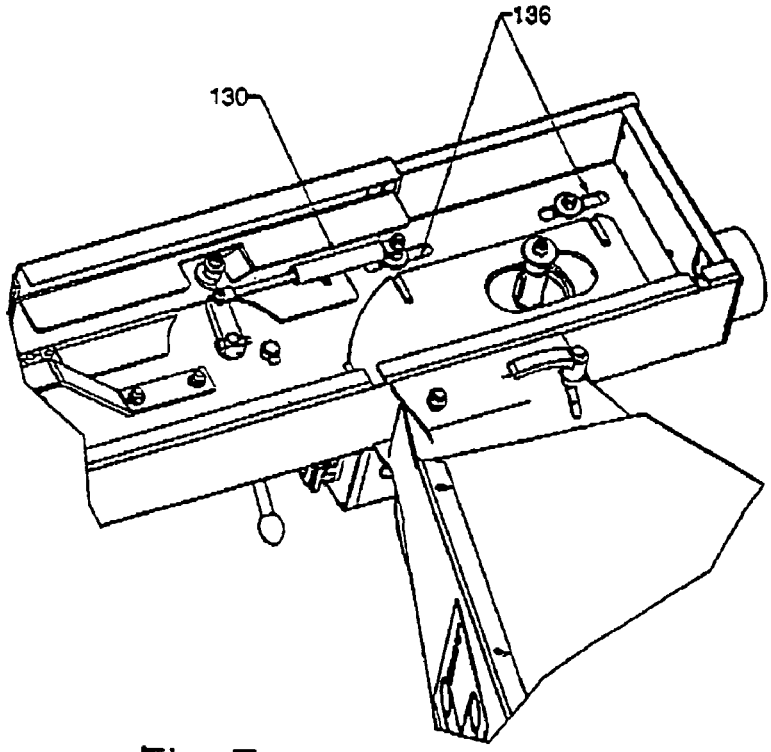
FIG. 7 is a schematic diagram of a view of a belt tension mechanism in a belt grinder not including a contact disc and driving disc, in accordance with an embodiment of the present invention.

FIG. 7 is a schematic diagram of a view of a belt tension mechanism in a belt grinder 100 not including a contact disc 112 and driving disc 108, in accordance with an embodiment of the present invention. FIG. 7 shows additional details, such as, an additional elongated hole 136 under the driving disc 108 that is used for adjustments. Additional elongated holes 136 can be used as guides.

Figure 8:
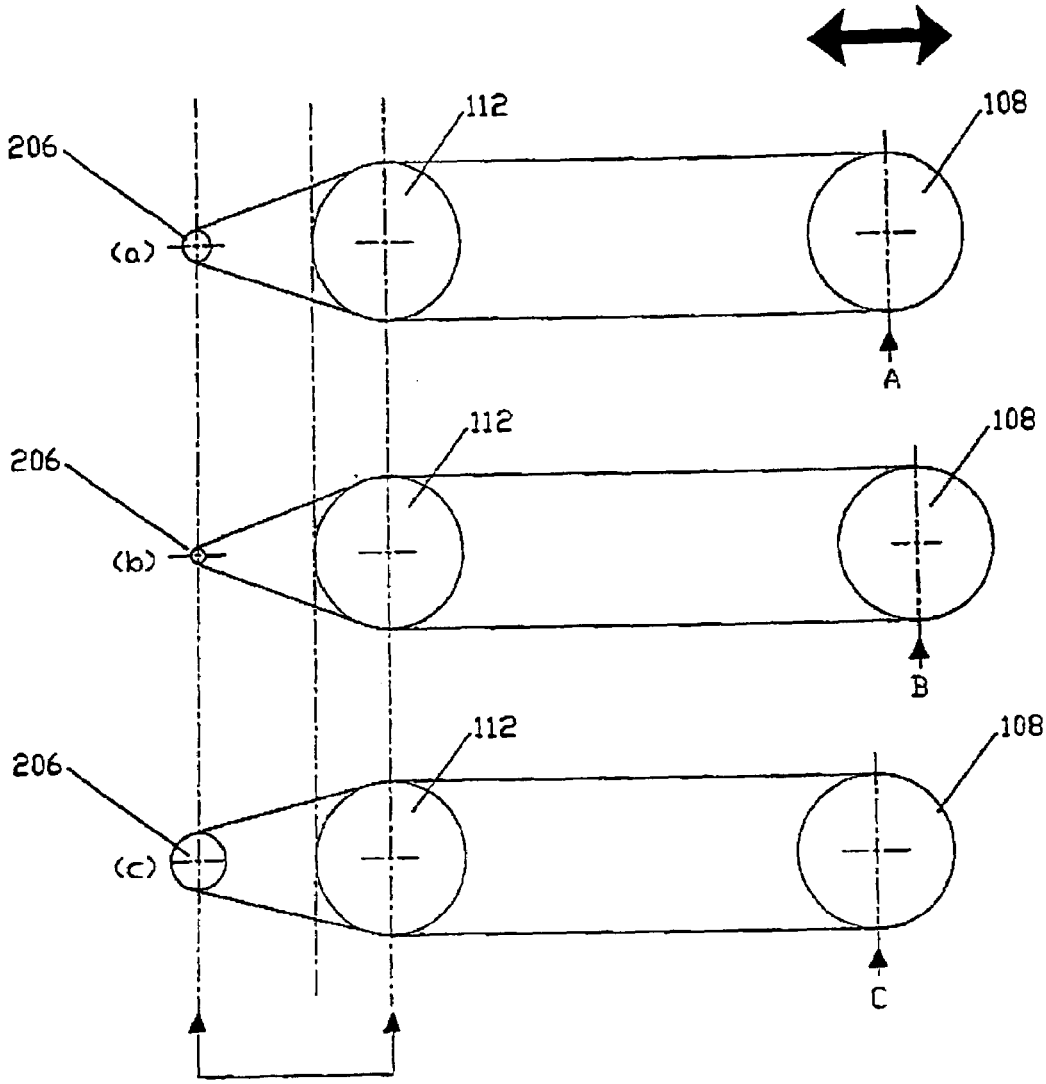
FIG. 8 is a schematic diagram showing the relative placement of a driver disc with respect to a contact disc for contact rolls of varying diameter, in accordance with an embodiment of the present invention.

FIG. 8 is a schematic diagram showing the relative placement of a driver disc 108 with respect to a contact disc 112 for contact rolls 206 of varying diameter, in accordance with an embodiment of the present invention. Segments (a), (b), and (c) show that despite varying contact role 206 diameters and a constant center to center distance between contact role 206 and immovable contact disc 112, the same grinding belt with optimal belt tension and length can be used by moving the driving disc 108 relative to contact disc 112. In other words, the center to center distance between contact role 206 and contact disc 112 remains constant while driving disc 108 can be correspondingly moved. When the position of driving disc 108 has been chosen, the belt tension is optimized using a mechanism for adjusting the tension of the grinding belt, as is described above.

Figure 9:
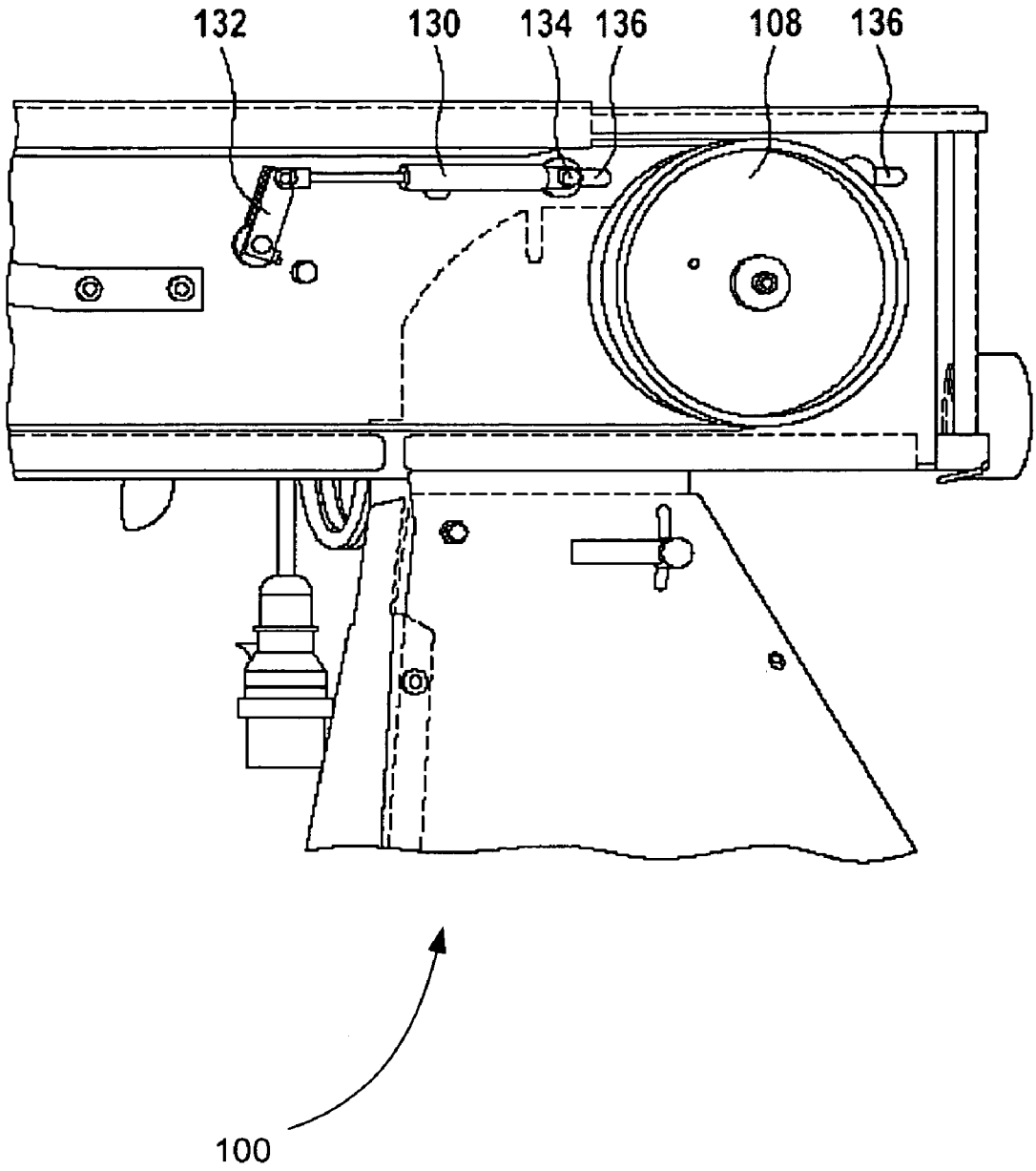
FIG. 9 is a schematic diagram of a side view of a pneumatic spring that is movable in an elongated hole, viewed from a slightly forward leaning angle, in accordance with an embodiment of the present invention.

FIG. 9 is a schematic diagram of a side view of a pneumatic spring 130 that is movable in an elongated hole 136, viewed from a slightly forward leaning angle, in accordance with an embodiment of the present invention. End 132 of the pneumatic spring is immovable. End 134 is moveable along elongated hole 136. The movement of end 134, in turn, moves driving disc 108, which is fitted with a grinding belt.

Figure 10:
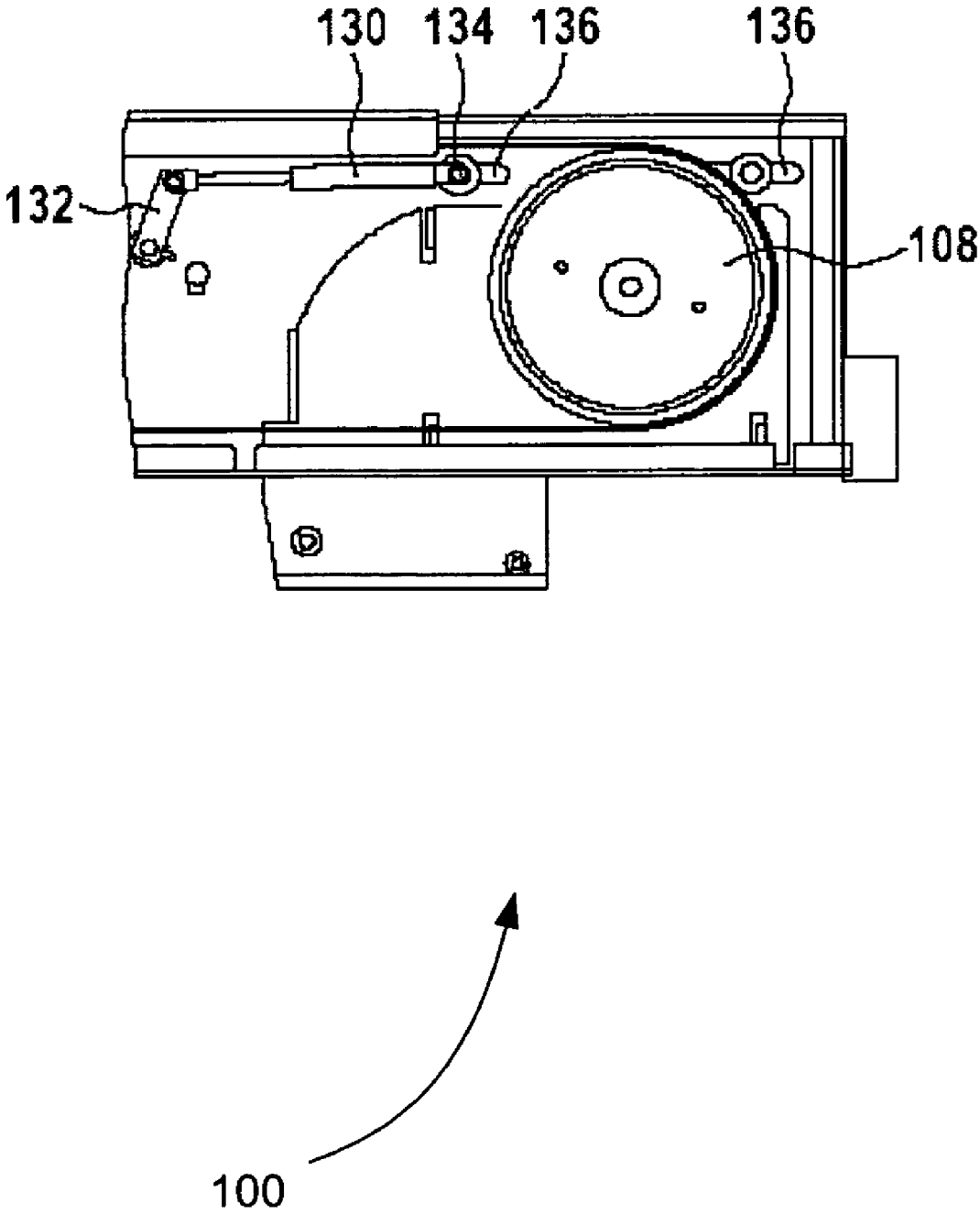
FIG. 10 is a schematic diagram of a direct side view of a pneumatic spring that is movable in an elongated hole, in accordance with an embodiment of the present invention.

FIG. 10 is a schematic diagram of a direct side view of a pneumatic spring that is movable in an elongated hole, in accordance with an embodiment of the present invention. FIG. 10 schematically shows the same elements as shown in FIG. 9, but FIG. 10 is a direct side view. Back end 134 of pneumatic spring 130 is positioned approximately at the center point of elongated hole 136 and is thus partially tensioned.

Figure 11:
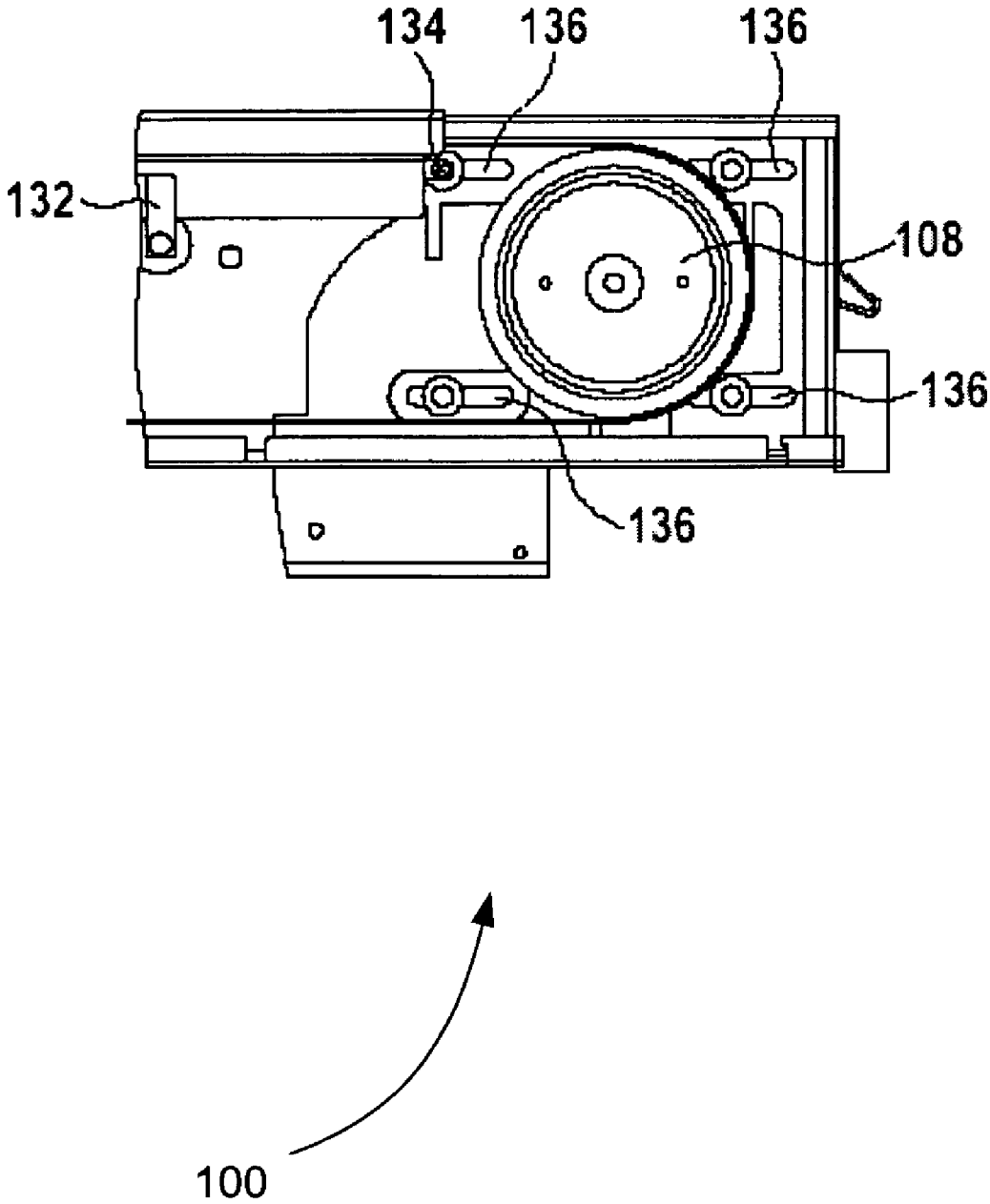
FIG. 11 is a schematic diagram of a direct side view of a tensioned pneumatic spring in the anterior position of an elongated hole, in accordance with an embodiment of the present invention.

FIG. 11 is a schematic diagram of a direct side view of tensioned pneumatic spring 130 in the anterior position of elongated hole 136, in accordance with an embodiment of the present invention. Pneumatic spring 130 is in the almost completely tensioned position as end 132 is almost in a vertical position and end 134 is placed far in the far end of the elongated hole 136. Additional elongated holes 136 are also shown.

Figure 12A:
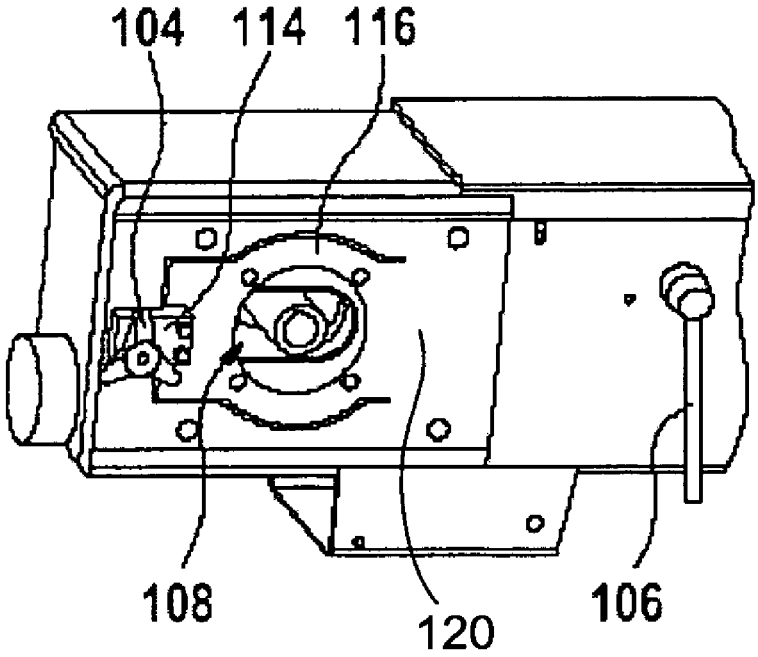
FIG. 12A is a schematic diagram of a diagonal side view of a cover plate connected to a belt grinder so that a moveable portion of a motor flange of the cover plate is pointing in a direction substantially opposite to the direction of the belt of the belt grinder, in accordance with an embodiment of the present invention.
Figure 12A:
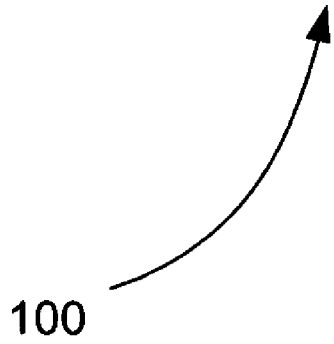

FIG. 12A is a schematic diagram of a diagonal side view of a cover plate 120 connected to a belt grinder 100 so that a moveable portion of a motor flange 116 of cover plate 120 is pointing in a direction substantially opposite to the direction of the belt of the belt grinder 100, in accordance with an embodiment of the present invention. Cover plate 120 is fastened onto the side of belt grinder 100 housing using four elongated holes 136 (shown in FIG. 11). Cover plate 120 includes motor flange 116, which is fixed to cover plate 120 on one end and is moveable on the other end. Cover plate 120 also includes star shaped screw 104 that functions as a threaded spindle. Star shaped screw 104 is used to move motor flange 116 relative to cover plate 120.

Figure 12B:
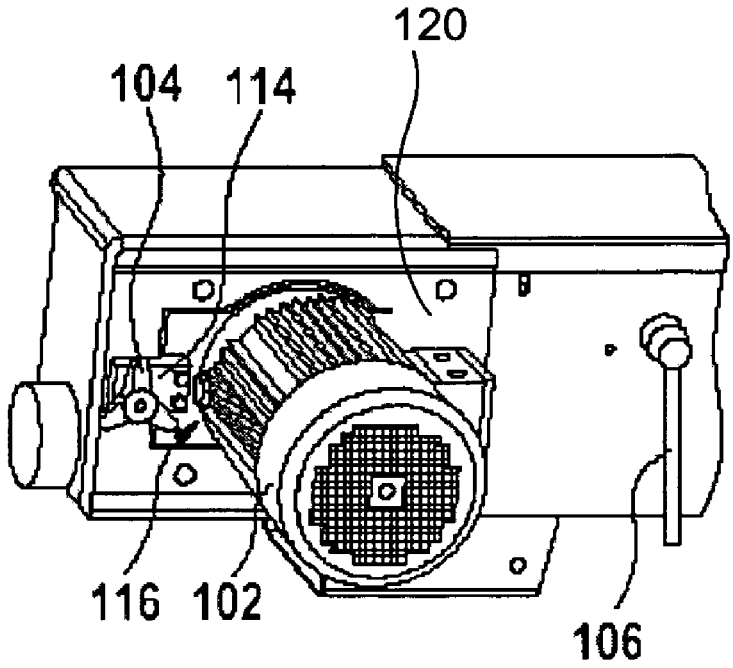
FIG. 12B is a schematic diagram of a diagonal side view of a motor attached to a cover plate connected to a belt grinder so that a moveable portion of a motor flange of the cover plate is pointing in a direction substantially opposite to the direction of the belt of the belt grinder, in accordance with an embodiment of the present invention.
Figure 12B:
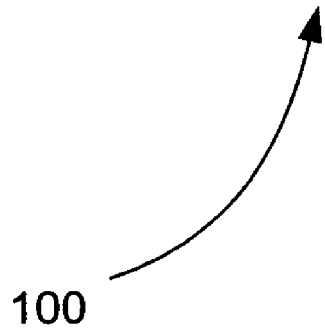

FIG. 12B is a schematic diagram of a diagonal side view of a motor 102 attached to a cover plate 120 connected to a belt grinder 100 so that a moveable portion of a motor flange 116 of cover plate 120 is pointing in a direction substantially opposite to the direction of the belt of belt grinder 100, in accordance with an embodiment of the present invention. Motor 102 is attached to motor flange 116 of cover plate 120 and driving disc 108 (shown in FIG. 12A). Before adjusting star shaped screw 104, the axis of motor 102 and driving disc 108 is substantially perpendicular to the plane of cover plate 120 and substantially parallel to the axis of contact disc 112. After adjusting star shaped screw 104, the axis of motor 102 and driving disc 108 is adjusted with respect to the plane of cover plate 120 and the axis of contact disc 112. Motor 102 and driving disc 108 are, therefore, translated laterally by adjusting star shaped screw 104. In FIGS. 12A and 12B lever 106, which regulates the pneumatic spring tension, is pointed downwards which indicates that the pneumatic spring is almost fully extended.

Figure 13A:
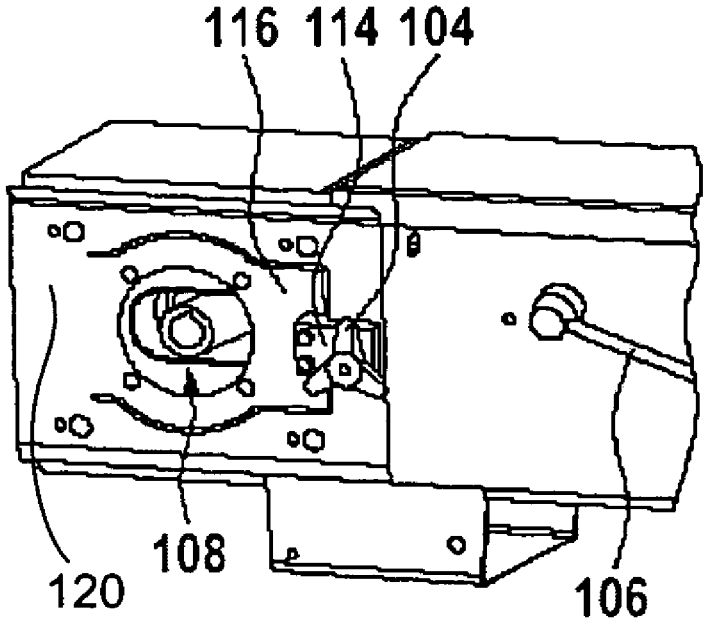
FIG. 13A is a schematic diagram of a diagonal side view of a cover plate connected to a belt grinder so that a moveable portion of a motor flange of the cover plate is pointing in a direction substantially the same as the direction of the belt of the belt grinder, in accordance with an embodiment of the present invention.
Figure 13A:
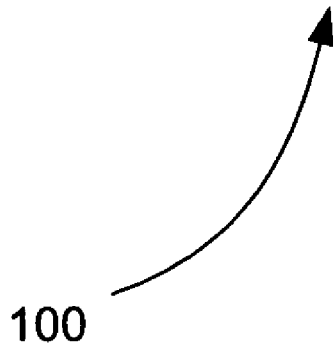

FIG. 13A is a schematic diagram of a diagonal side view of a cover plate 120 connected to a belt grinder 100 so that a moveable portion of a motor flange 116 of cover plate 120 is pointing in a direction substantially the same as the direction of the belt of belt grinder 100, in accordance with an embodiment of the present invention.

Figure 13B:
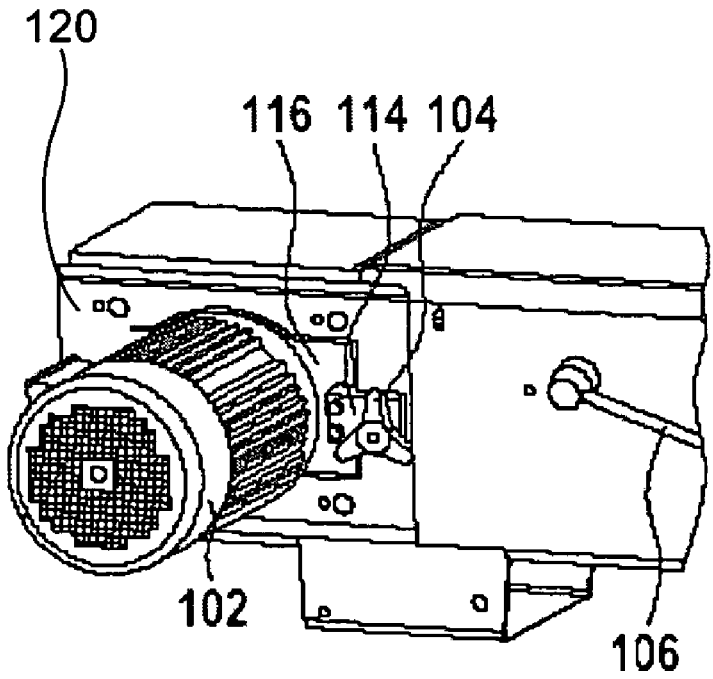
FIG. 13B is a schematic diagram of a diagonal side view of a motor attached to a cover plate connected to a belt grinder so that a moveable portion of a motor flange of the cover plate is pointing in a direction substantially the same as the direction of the belt of the belt grinder, in accordance with an embodiment of the present invention.
Figure 13B:
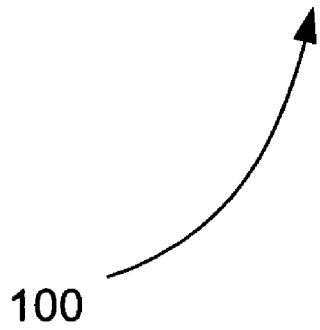

FIG. 13B is a schematic diagram of a diagonal side view of a motor 102 attached to a cover plate 120 connected to a belt grinder 100 so that a moveable portion of a motor flange 116 of cover plate 120 is pointing in a direction substantially the same as the direction of the belt of the belt grinder, in accordance with an embodiment of the present invention. In FIGS. 13A and 13B lever 106, which regulates the pneumatic spring tension, is pointed forwards which indicates that the pneumatic spring is almost fully relaxed.

FIGS. 12A and 13A show that cover plate 120 can be connected to belt grinder 100 in different ways. FIGS. 12B and 13B show that connecting cover plate 120 to belt grinder 100 in different ways allows motor 102 and driving disc 108 to be moved laterally in either direction. In FIG. 12B, the position of star shaped screw allows the angle made between the center of motor 102, the center of driving disc 108, and the center of contact disc 112 to be adjusted from ninety degrees to angle less than ninety degrees. In FIG. 13B, the position of star shaped screw allows the angle made between the center of motor 102, the center of driving disc 108, and the center of contact disc 112 to be adjusted from ninety degrees to angle greater than ninety degrees.

Figure 14A:
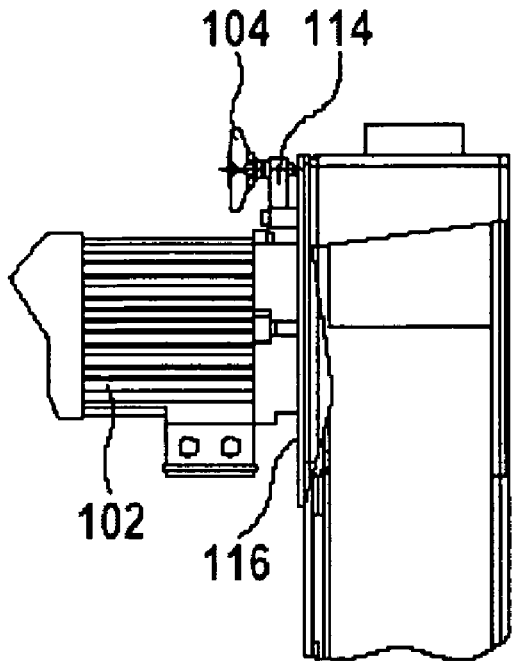
FIG. 14A is a schematic diagram of a top view of a motor attached to a cover plate connected to a belt grinder so that a moveable portion of a motor flange of the cover plate is pointing in a direction substantially opposite to the direction of the belt of the belt grinder, in accordance with an embodiment of the present invention.
Figure 14A:
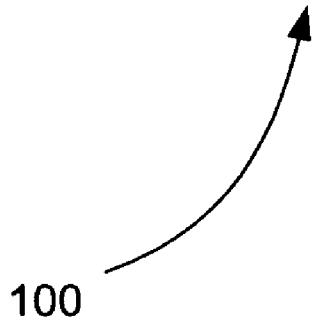

FIG. 14A is a schematic diagram of a top view of a motor 102 attached to a cover plate 120 connected to a belt grinder 100 so that a moveable portion of a motor flange 116 of cover plate 120 is pointing in a direction substantially opposite to the direction of the belt of belt grinder 100, in accordance with an embodiment of the present invention. When a moveable portion of a motor flange 116 of cover plate 120 is pointing in a direction substantially opposite to the direction of the belt of belt grinder 100, star shaped screw 104 is located between motor 102 and the back of belt grinder 100. In this starting position, before any adjustment is made, the axis of motor 102 and disc 108 is substantially perpendicular to cover plate 120 and to a plane of rotation of the grinding belt, and is substantially parallel to the axis of contact disc 112. From this starting position, star shaped screw 104 can move motor flange 116 away from cover plate 120 and tip motor 102 toward the front of belt grinder 100, which allows adjustment of the correct grinding belt position and grinding belt tension.

Figure 14B:
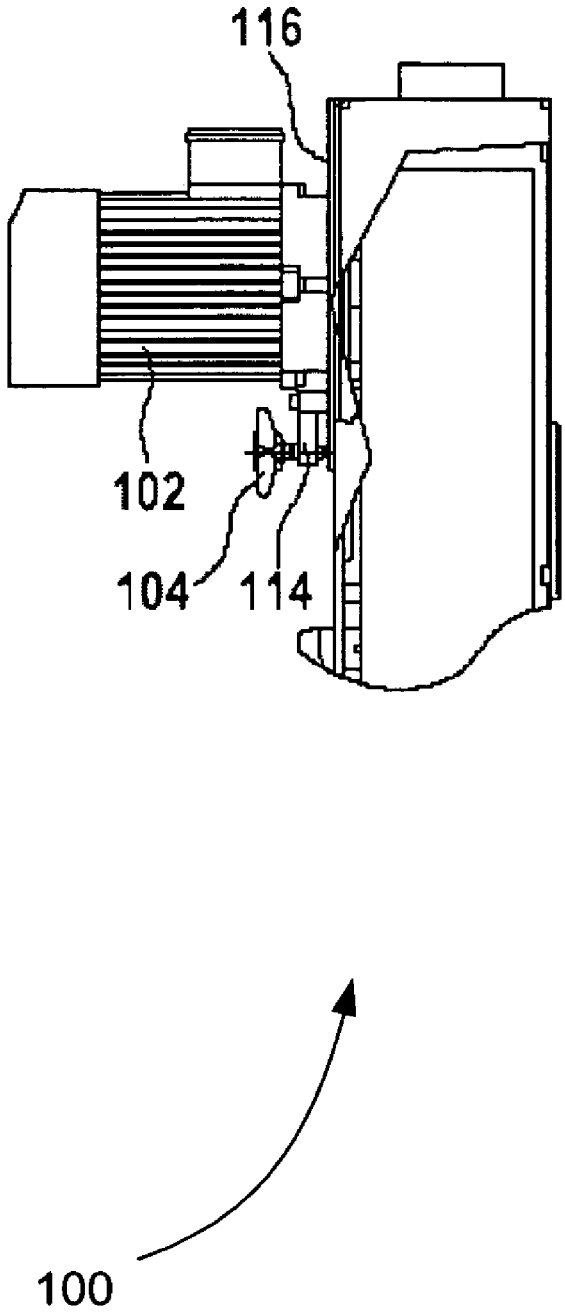
FIG. 14B is a schematic diagram of a top view of a motor attached to a cover plate connected to a belt grinder so that a moveable portion of a motor flange of the cover plate is pointing in a direction substantially the same as the direction of the belt of the belt grinder, in accordance with an embodiment of the present invention.

FIG. 14B is a schematic diagram of a top view of a motor 102 attached to a cover plate 120 connected to a belt grinder 100 so that a moveable portion of a motor flange of cover plate 120 is pointing in a direction substantially the same as the direction of the belt of belt grinder 120, in accordance with an embodiment of the present invention. When a moveable portion of a motor flange 116 of cover plate 120 is pointing in a direction substantially the same as the direction of the belt of belt grinder 100, star shaped screw 104 is located between motor 102 and the front of belt grinder 100. In this starting position, before any adjustment is made, the axis of motor 102 and disc 108 is substantially perpendicular to cover plate 120 and to a plane of rotation of the grinding belt, and is substantially parallel to the axis of contact disc 112. From this starting position, star shaped screw 104 can move motor flange 116 away from cover plate 120 and tip motor 102 toward the back of belt grinder 100, which allows adjustment of the correct grinding belt position and grinding belt tension.

The foregoing disclosure of the preferred embodiments of the present invention has been presented for purposes of illustration and description. It is not intended to be exhaustive or to limit the invention to the precise forms disclosed.

Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary shill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A belt grinder, comprising:

a motor;

a driving disc coupled to the motor;

a contact disc;

a grinding belt routed over the driving disc and the contact disc;

a housing enclosing the driving disc, the contact disc, and the driving belt;

a cover plate slideably mounted to the housing, wherein the motor is connected to the cover plate; and a pneumatic spring connected at one end to a lever and at an opposite end to the cover plate, wherein the lever is connected to the housing and wherein the lever moves the pneumatic spring and the cover plate to vary a distance between an axis of the contact disc and an axis of the driving disc;

a motor flange fixed at one end to the cover plate and moveable at an opposite end, wherein the motor is connected to the motor flange; and a threaded spindle connected to the cover plate and the opposite end of the motor flange, wherein the threaded spindle moves the opposite end of the motor flange away from the cover plate to vary an angle between an axis of the contact disc and an axis of the driving disc.

2. A belt grinder, comprising:

a motor;

a driving disc coupled to the motor;

a contact disc;

a grinding belt routed over the driving disc and the contact disc;

a housing enclosing the driving disc, the contact disc, and the driving belt;

a cover plate slideably mounted to the housing, wherein the motor is connected to the cover plate; and a pneumatic spring connected at one end to a lever and at an opposite end to the cover plate, wherein the lever is connected to the housing and wherein the lever moves the pneumatic spring and the cover plate to vary a distance between an axis of the contact disc and an axis of the driving disc;

a motor flange fixed at one end to the cover plate and moveable at an opposite end, wherein the motor is connected to the motor flange;

a threaded spindle connected to the cover plate and the opposite end of the motor flange, wherein the threaded spindle moves the opposite end of the motor flange away from the cover plate to vary an angle between an axis of the contact disc and an axis of the driving disc; and an attachment secured to the belt grinder that comprises at least one contact roll around which the grinding belt is fitted.

3. The belt grinder of claim 2, wherein the attachment comprises a collecting tank for shavings.

4. The belt grinder of claim 3, wherein the collecting tank is filled with a cooling medium.

5. The belt grinder of claim 2, wherein the attachment comprises a mechanical locking device.

6. The belt grinder of claim 2, wherein a center to center distance between the at least one contact roll and the contact disc is maintained as a diameter of the at least one contact roll is varied through the use of the pneumatic spring and the lever.

* * * * *